United States Patent [19]

Fox

[11] Patent Number: 4,600,198

[45] Date of Patent: Jul. 15, 1986

[54] LOTTO CONTEST NUMBER CHECKING DEVICE

[76] Inventor: Delbert H. Fox, 841 Southwood Dr., Fenton, Mich. 48430

[21] Appl. No.: 676,755

[22] Filed: Nov. 28, 1984

[51] Int. Cl.[4] ..... A63F 3/06

[52] U.S. Cl. ..... 273/148 R; 40/525; 434/426

[58] Field of Search ..... 273/148 R, 269; 434/173, 197, 426; 40/524, 525

[56] References Cited

U.S. PATENT DOCUMENTS 3,628,453 12/1971 Jackson et al. ..... 434/173 X

FOREIGN PATENT DOCUMENTS 2435271 5/1980 France ..... 273/148 R

*Primary Examiner*—Anton O. Oechsle

[57] ABSTRACT

A device for checking columnar arranged digits on lotto tickets. Winning number combinations are preset on the device. The preset numbers are linearally arranged at one end of the device for alignment with the digits printed on the lotto tickets. Pre-setting is accomplished by tape and thumbwheel set ups.

4 Claims, 4 Drawing Figures

LOTTO CONTEST NUMBER CHECKING DEVICE

BACKGROUND OF THE INVENTION

In lotto contests a plurality of single or double digit numbers are preselected and printed on tickets prior to the drawing. After the drawing, the winning numbers are announced. A problem arises in making an accurate and rapid check of the lotto numbers that have been selected by the participant. A number of variations of lotto games and lotto tickets are known in the different states in which games are sponsored. The tickets frequently include a large number of entries arranged one after the other according to the participants number choices. Trying to check each entry is exceedingly difficult for the participant who has to follow the winning number across the columns to verify that he has a winning combination. In the Michigan State Lottery, as an example, there are six columns of numbers with number possibilities ranging from 1–40 in each column.

A number of devices are known by the prior art for storing and for indicating certain digital information. One such indicating device showing the location in a parking lot is shown and described in U.S. Pat. No. 4,258,491 issued on Mar. 31, 1981 to Ernst et. al. for "Location Indicating Device." An additional memory aid for digits is shown in U.S. Pat. No. 2,945,312 issued on July 19, 1960 to A. R. Book for "Memory Aid." A still further reminder of numbers used for telephone numbers is shown and described in U.S. Pat. No. 3,864,857 issued on Feb. 11, 1975 to B. H. Brude for "Telephone Number Recorder and Reminder."

SUMMARY OF THE INVENTION

The present invention relates to a conveniently carried and used manual device for pre-setting winning numbers at a viewing end. The numbers are spaced to correspond to the columnar arrangement of numbers preselected and printed on a lotto ticket. The preselected numbers printed on the ticket typically occur in a long array of numbers. By pre-setting the winning number on the device, its possible to set up the winning combination and then to arrange the digital array in a position juxtaposed to each row. Comparison is then made by a row to row movement of the device. To facilitate movement of the device over a long line up of lotto numbers selected, a pair of pegs are mounted at the bottom of the device to permit easy sliding up or down the number of columns on the ticket.

BRIEF DESCRIPTION OF THE DRAWINGS

The present invention will now be described with reference to the accompanying specification and the drawings in which like numerals are used to refer to like elements in the several views and in which.

DETAILED DESCRIPTION OF THE PREFERRED EMBODIMENT

Figure 1:
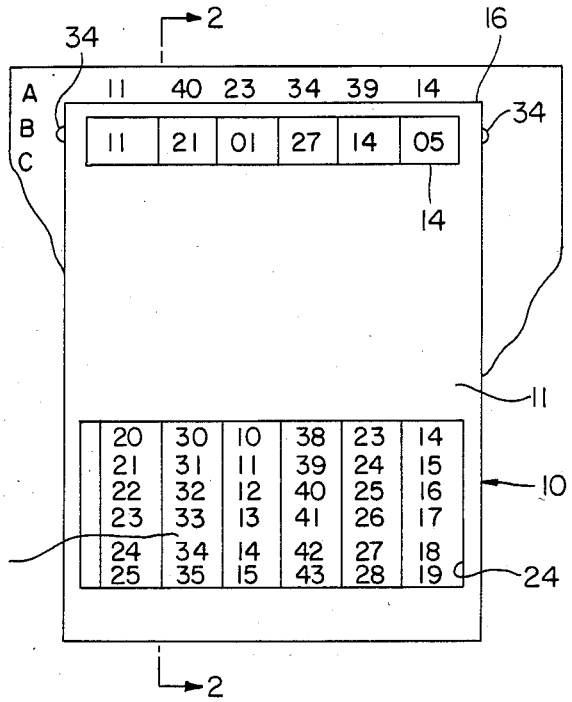
FIG. 1 is a top plan view showing one type of indicating device.

FIG. 1 shows the indicating device 10 as it is aligned with a lotto ticket 12. It will be seen that the lotto ticket

Figure 2:
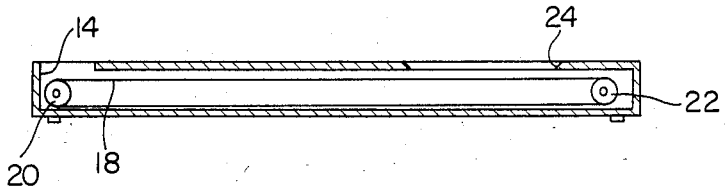
FIG. 2 is a sectional view taken along the section line 2—2 of FIG. 1.

12 has printed on it a number of columns of figures that have been preselected by the lotto participant. These are preprinted on the ticket and are arranged in a plurality of rows A, B, and C and the like. An indicating device 10 includes a case 11 that has an opening 14 in its upper surface. The opening 14 permits the viewing of the winning combination of numbers. These are arranged close to the forward end 16 of the device to permit lineup and comparison of each of the printed rows of numbers in the lotto ticket 12 to the winning combination of numbers as preset on the indicating device 10. Inside the case 11, the numbers are arranged sequentially on a plurality of side by side tapes 18, six in number to match the present line up of numbers on the lotto ticket 12. The manner in which the device 10 is constructed is further shown in FIG. 2. It will be seen that the opening 14 is located proximate the forward edge of the indicating device 10. One of the several number bearing tapes 18 is shown mounted over a spaced pair of rollers 20 and 22 which are rotatable to set the desired indicia on the tape in the viewing window or opening 14. A second opening 24 is provided through the upper surface of the case 11 at the rearward end of the indicating device so that each individual tape 18 may be thumbed into the position desired to display the winning number on it.

Figure 3:
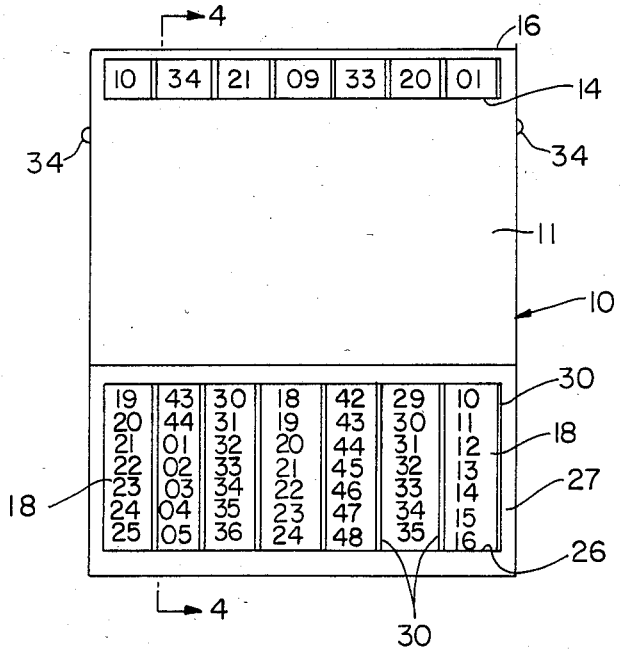
FIG. 3 is a top plan view showing an alternate embodiment of my invention.
Figure 4:
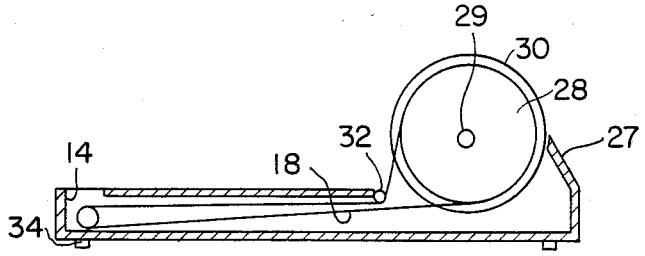
FIG. 4 is a sectional view taken along the section line 4—4 FIG. 3.

FIGS. 3 and 4 show a different embodiment of the invention in which there is provided the viewing window 14 proximate the forward end 16 of the indicating device. A second opening 26 is formed in the upper surface of the case 11 of the indicating device 10 to permit line up of the winning combination on each of several tapes 18. To facilitate registering of the numbers on the tapes 18, there is provided a raised barrel portion 27 for containing a roller 28 for each of the seven tapes 18. The rollers 28 are rotatively mounted on a transverse shaft 29. Mounted at one side of each of the rollers 28 there is provided a raised thumbing portion 30 preferably with ridges or serations to permit easy turning of the tape to register the winning digit in the window opening 14. An idler roller 32 is further included to support and tension each of the tapes 18. Also shown in FIGS. 1 and 3 are a pair of pegs 34 extending from the lower surface of the body 11 of the device 10 and adapted to provide rapid sliding movement of the indicating device with the preset numbers along the length of the lotto ticket 12.

It will thus be seen that I have provided by my invention a novel device for checking lotto numbers on the lotto tickets. It permits the checking to be done quickly and accurately with a minimum of effort.

I claim:

1. A lotto ticket checking device for comparing a winning number to a plurality of preselected numbers printed in rows and columns on the ticket, comprising;

a case;

a first, viewing opening in the upper surface of said case proximate one end thereof;

a plurality of indicia bearing tapes rotatively mounted side by side in said case and registerable to a position displaying the digits of the winning number through said opening;

a second opening proximate the other end of the case and extending through its upper surface for permitting thumbing of each tape into its position relative to said viewing opening; and a plurality of pegs mounted on the lower surface of said case for facilitating its sliding movement lengthwise over a lottery ticket in a row by row fashion.

2. The combination as set forth in claim 1 in which each of said tapes are mounted on an enlarged rotatable roller, each of said rollers further having a raised thumbing portion for facilitating ragistering of the displayed winner numbers in the viewing window.

3. The combination as set forth in claim 2 in which a further idler roller is included in the path of each of said tapes for supporting it in its movement.

4. The combination as set forth in claim 3 in which said rotatable rollers are mounted in a raised barrel portion of said case proximate its rearward end.

* * * * *